United States Patent [19]

Virk

[11] 4,395,875

[45] Aug. 2, 1983

[54] METHOD FOR REJUVENATING AN EXHAUST GAS FILTER FOR A DIESEL ENGINE

[75] Inventor: Kashmir S. Virk, Hopewell Junction, N.Y.

[73] Assignee: Texaco Inc., White Plains, N.Y.

[21] Appl. No.: 286,318

[22] Filed: Jul. 24, 1981

[51] Int. Cl.[3] ..... F01N 3/02

[52] U.S. Cl. ..... 60/274; 60/286; 60/297; 60/303; 60/311; 123/198 F

[58] Field of Search ..... 60/274, 286, 303, 311, 60/284, 297; 123/198 F

[56] References Cited

U.S. PATENT DOCUMENTS

| | | | |
|---|---|---|---|
| 4,165,610 | 8/1979 | Iizuka | 60/284 |
| 4,248,198 | 2/1981 | Deutschmann | 123/198 F |
| 4,274,373 | 6/1981 | Sugasawa | 123/198 F |
| 4,284,042 | 8/1981 | Springer | 123/198 F |
| 4,319,896 | 3/1982 | Sweeney | 60/311 |
| 4,322,387 | 3/1982 | Virk et al. | 55/DIG. 30 |
| 4,333,428 | 6/1982 | Tanaka | 123/198 F |

*Primary Examiner*—Douglas Hart

*Attorney, Agent, or Firm*—Carl G. Ries; Robert A. Kulason; Robert B. Burns

[57] ABSTRACT

Method for rejuvenating the exhaust gas filter for a diesel engine in which the engine's power output can be varied by eliminating the function of one or more cylinders during a period of engine operation. Said method includes immobilizing at least one, and preferably a number, of the engine's cylinders by maintaining the respective intake, and optionally the exhaust valves, in a fixed position. When exhaust gas is at a relatively low temperature, particle incineration is achieved by periodically injecting a small amount of fuel into the immobilized cylinder. The fuel is carried by the exhaust gas stream into the filter, where it is contacted by a catalyst bed to ignite the gas and to thereby raise it to a sufficient temperature to ignite retained combustible particles.

8 Claims, 3 Drawing Figures

FIG. 1
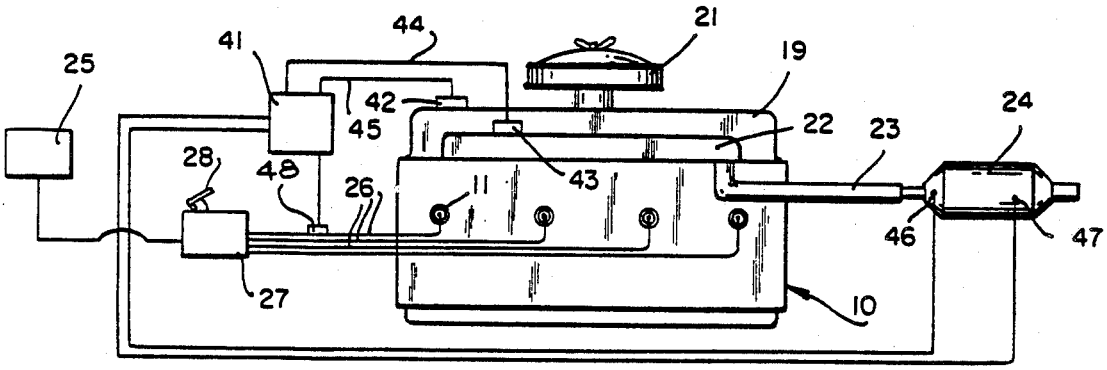
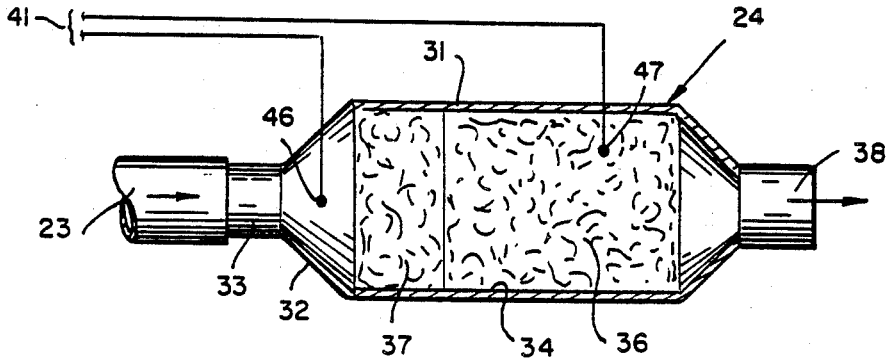
FIG. 2
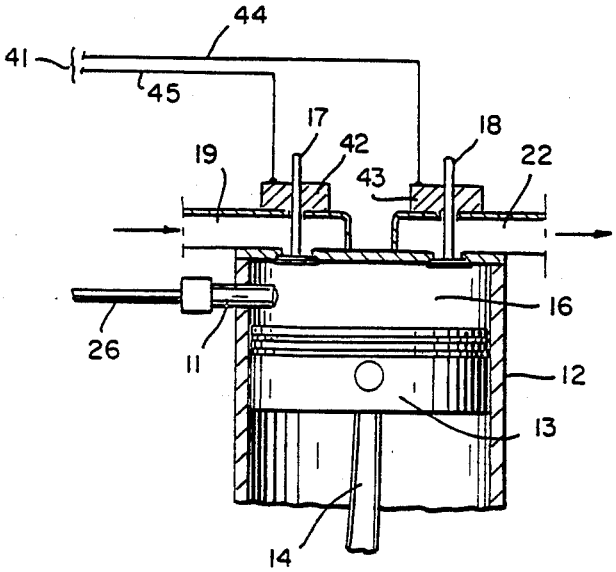
FIG. 3

METHOD FOR REJUVENATING AN EXHAUST GAS FILTER FOR A DIESEL ENGINE

BACKGROUND OF THE INVENTION

In any internal combustion engine it is desirable to operate the unit in a manner to minimize the amount of pollutants which are discharged into the air. In the instance of a diesel engine, one of the more objectionable elements which is carried by the exhaust gas stream, comprises minute particles of unburned carbon. These particles are manifested in the hot exhaust gas stream by causing the latter to be highly visible with a decidedly black color.

The problem of diesel exhaust gas has been partially overcome by the provision of suitable exhaust gas filters. In such filters, the hot exhaust gas is passed through a filtering bed which is capable of retaining combustible particulate matter. The particle free gas is then discharged into the atmosphere.

After a period of time however, the combustible particulate matter will accumulate in the filter bed to such an extent as to impair the free flow of gas through the bed. When this occurs, a considerable backpressure will be created within the filter, thereby impairing efficient operation of the engine.

As a necessity toward maintaining the engine in good running condition, combustible particulate matter must be removed from the filter. This is often achieved merely by running the engine in a manner that the exhaust gas as it leaves the engine is at a temperature sufficient to cause ignition of the retained particles. Since these particles are normally unburned carbon, it is only necessary to raise the exhaust gas to a temperature of about 1000° F.

When, however, the engine is running under minimal load conditions, and the exhaust gas is relatively cool at approximately 500° F., the carbon particles will not be ignited. Rather, they will be retained and accumulated in the filter section. To achieve the combusting of retained particles, the exhaust gas temperature must be raised to within the desired particle ignition temperature range.

One method for treating low temperature exhaust gas is by introducing a stream of readily combustible fuel into the exhaust gas stream. The gas/fuel mixture will thereafter be passed into the filter's catalyst bed, wherein ignition of the fuel is prompted. The temperature within the catalyst section, as well as the exhaust gas therein, will thus be raised considerably.

Thereafter, gas passing through the filter bed will be heated to effectuate ignition of the combustible particles within the downstream, particle retaining bed.

Among the more recent fuel injection engine developments adapted for conserving fuel, is a type of engine which is powered to operate under heaviest load and accelerating conditions without burning an excessive amount of fuel. This is achieved by use of a multi-cylinder engine having means communicated therewith for immobilizing one or more of the engine's cylinders in response to a load condition.

For example, in the instance of an 8 cylinder diesel engine, the latter might normally be required to operate on four or six cylinders for the major part of its operating period. Yet, for times when the engine must suddenly accelerate, or is subjected to a load heavier than usual, it is desirable to have greater power output.

Under such demands, all cylinders of the engine will operate.

For those circumstances wherein full power is required, all the cylinders will automatically become fully operable. For example, all eight cylinders will receive a fuel charge which is intermixed with incoming air. Thereafter, each of the eight cylinders fires in its normal rotation to afford the engine its maximum power output in response to a load condition.

When on the other hand, the engine is running at a normal speed and under less than maximum power, at least one and preferably an even number of cylinders are immobilized.

The means for immobilizing a cylinder is afforded through use of a valve mechanism which is attached to at least some of the intake and exhaust valves. Thus, said valves can be locked in either the fully open or fully closed position.

When the valves are so locked, and when the fuel charge to the immobilized cylinder is discontinued, the piston will merely reciprocate in its normal manner, without imparting output to the engine drive shaft.

During the period of immobilization, the inoperable cylinder or cylinders will receive only a flow of exhaust gas which passes therethrough with no compression being built up.

The immobilized cylinder will continue to function in such manner until the exhaust gas filter becomes rejuvenated, or until an additional load in the form of a need for quick acceleration or a heavier output torque is imposed on the engine. In either instance, the immobilized cylinders will be caused to become instantly operable, by release of the valves, and fuel injection to all cylinders will be reestablished.

In the present arrangement, means are provided for controlling operation of the engine's respective cylinders which are adapted to be selectively immobilized during the engine operating periods. The intake valves, and optionally the exhaust valves of these respective cylinders, are operably communicated with an engine control mechanism.

As each successive cylinder becomes immobilized by adjusting the valve or valves to a fixed position, fuel flow to the cylinder is discontinued. Thereafter, the exhaust filter bed is purged of carbon particles by injecting a measured amount of fuel into the immobilized cylinder. The fuel is then swept up in the exhaust stream to form a combustible, gas/fuel mixture.

It is therefore an object of the invention to provide a method for operating an engine of the type contemplated which is adapted to function with a selective number of cylinders in a manner to avoid the discharge of undesirable, unburned hydrocarbon into the atmosphere. A further object is to provide a method for operating an engine of the type contemplated, wherein the exhaust gas filter is periodically rejuvenated to incinerate accumulated combustible particles. A still further object of the invention is to provide a method for operating an engine-exhaust gas filter combination of the type herein contemplated, wherein supplementary fuel enters the exhaust gas stream in a manner to be combusted within the exhaust gas filter thereby elevating the temperature of the stream.

DESCRIPTION OF THE DRAWINGS

FIG. 1 is a schematic illustration of an engine of the type contemplated connected to an exhaust gas filter. FIG. 2 is a segmentary view in cross section of the exhaust gas filter in FIG. 1. FIG. 3 is an enlarged segmentary view in cross section of an engine cylinder.

In FIG. 1, an engine 10 of the type generally contemplated is shown as of the diesel or fuel injection type. The latter is provided with eight cylinders although only four are presently illustrated in the form of four fuel injectors 11. Each of the latter is communicated with combustion chamber 16 of a single cylinder 12. As mentioned herein, the actual number of cylinders in the engine is optional, being 6, 8, 12 or whatever is required.

As shown in FIG. 3, each cylinder 12 is provided with a piston 13 which is reciprocally mounted in the cylinder by a piston rod 14. Operationally, in the normal manner, piston 13 is caused to reciprocate through cylinder 12 in response to the explosive combustion event which takes place within the cylinder's combustion chamber 16.

Combustion chamber 16 is provided with at least one fuel injector nozzle 11 positioned in the combustion chamber upper end. Chamber 16 is further provided with an intake valve 17 as well as an exhaust valve 18.

For operating efficiency, the respective intake valves 17 are mutually communicated by way of a common intake manifold 19, to an air intake filter 21. The latter is in turn communicated with the atmosphere. In a similar manner, exhaust valves 18 are communicated through a common exhaust manifold 22. Thus, the hot exhaust gas stream can be conducted through an exhaust gas conduit 23 to exhaust gas filter 24.

Operationally, diesel engine 10 functions in response to the injection of the required amount of fuel into the various cylinders 12. This is achieved through a fuel injection system comprising primarily the herein mentioned fuel injectors 11 which are communicated with each cylinder 12. Each injector 11 further is communicated by a fuel line 26 to a fuel metering pump 27.

The latter is provided with a control lever 28 which is manipulated by an operator to vary the fuel flow from a fuel source 25, to the respective cylinders and consequently to vary the power output of engine 10.

Under engine operating conditions, each of the exhaust and intake valves 18 and 17 will be mechanically actuated between open and closed positions. This timed action achieves the normal four stroke operation of each piston 13. Thus, the respective intake and exhaust valves will be opened and closed in a desired time sequence, depending on the particular stroke, and position of piston 13.

This type of valve actuating mechanism is familiar in the engine art and will require no further explanation in order that the present invention might be fully understood.

It is noted, however, that normally operation of the respective valves 17 and 18 is achieved through a direct connection to the engine output or crankshaft, and to a supplementary cam shaft. As the cam shaft rotates, it adjusts the respective valves 17 and 18 through their timed open and closed positions in sequence.

In multi-cylinder diesel engines of the type contemplated, the engine's power output is varied by selectively immobilizing one or more of cylinders 12. It is preferred to immobilize cylinders in pairs in order to maintain the dynamic balance of the engine and to assure efficient operation. This however is not an essential requirement since the cylinders can be immobilized one by one to achieve the desired power output reduction.

Under maximum load, and rapid acceleration conditions, all eight cylinders will be in full operation and will be injected with equal amounts of fuel. Under the lightest load conditions on the other hand, the power output of the engine, and consequently the amount of fuel used by the engine can be substantially reduced.

Cylinder immobilization through valve control is effectuated through the facility of a valve override mechanism which is operably attached to each of the engine valves 17 and 18. Thus, the valve's normal timed function as governed by the engine cam shaft, can in effect be overridden. Stated otherwise, each intake and exhaust valve 17 and 18, can have its normal reciprocatory movement interrupted by the valve override mechanism.

The respective valves 17 and 18 can thereby be locked in either the fully opened or in fully closed mode. Concurrently, fuel injection to the immobilized cylinder or cylinders is discontinued. Thus, although the respective pistons 13 are actuated, they do not contribute any torque to the drive shaft.

Overriding of the normal intake and exhaust valve movement or function can be achieved through a number of mechanisms which are known in the art. Primarily, the mechanism includes means operably connected to each valve, and normally hydraulically or pneumatically powered. The valves are thereby physically disconnected from their primary actuating means.

Under any and all operating conditions, diesel engine 10, as with any internal combustion engine, will produce varying degrees and amounts of exhaust gas. Depending on the engine's operating characteristics, the exhaust gas stream can enter filter 24 at temperatures within a range of atmospheric to 1500° F. However, for filter 24 to function properly, the entering exhaust gas stream must periodically be elevated to a high enough temperature that retained carbon particles will be incinerated and not cause passage blockings.

Referring to FIG. 3, exhaust gas filter 24 is comprised primarily of a casing 31 having an inlet end 32 which is communicated through an inlet conduit 33 to exhaust gas conduit 23.

Filter casing 31 defines a filter chamber 34 which encloses a bed 36 formed of a filtering medium. The latter in one embodiment can be comprised of an alumina layer which is deposited onto a stainless steel substrate formed of randomly disposed stainless strips or fibers. The disposition and composition of exhaust filter bed 36 can assume a number of configurations. One of these is shown in my copending application Ser. No. 200,746 filed Oct. 27, 1980.

Exhaust gas filter 24 is further comprised of a gas treating chamber 37 disposed upstream of filter bed 36. Chamber 37 is provided at least in part with a combustion inducing catalyst. The catalyst can take the form of a thin layer of a catalytic material deposited on the alumina layer of the above noted stainless steel filter media. Catalyst chamber 37 is then communicated with the exhaust gas inlet 33 and initially receives the stream of exhaust gas, and gas/fuel mix which is delivered to the filter.

During a start-up operation of engine 10, exhaust gas will initially be at a low temperature when passed through catalyst chamber 37 and filter bed 36. During this initial period, solid particulate matter, carbon most notably, will be unburned and retained from the gas stream, onto the filter bed surfaces. The particle-free gas will then pass into the atmosphere through discharge port 38.

Engine 10 will continue to operate effectively over a period of time under such conditions, and the relatively low temperature exhaust gas will continue to cause the deposition of combustible particulate matter.

Eventually, unless the gas temperature exceeds about 1000° F., the amount of collected particulate matter will accumulate to the point where the passages within filter bed 36 become lessened or fully blocked. Concurrently, backpressure on the exhaust gas system will increase, thereby prompting a diminution in engine efficiency. When the latter occurs, it becomes necessary to rejuvenate filter bed 36 as herein noted, by initiating combustion of the carbon particles.

Engine 10 will be operated such that the entire eight cylinders will be called on to function only infrequently. More specifically, all eight cylinders will be required as a power source only at those limited times as when a sudden burst of acceleration is needed, or a relatively heavy load is encountered. Stated otherwise, the periods when the engine's entire bank of cylinders will be furnishing power are intermittent and their operation will be sustained for only short time periods.

For example, under normal engine operation either six or four of the cylinders will produce the required power output. The two or four idle cylinders will merely function idly with no fuel being injected thereto. During this period, ideally intake valve 17 of the immobilized cylinders will be maintained closed, and the exhaust valve 18 held open. Alternately, valve 13 will be permitted to operate in its normal manner. Exhaust gas will therefore be aspirated through open valve 18, and then be discharged on the piston 13 discharge stroke.

To facilitate rejuvenation of filter bed 36, at least one of the immobilized cylinders 12 is given a controlled injection of a secondary fuel. When injected into a non-working or immobilized cylinder, fuel will thus intermix with exhaust gas from the working cylinders and form a combustible fuel/gas mixture. This supplemental injection into a non-working cylinder can be achieved through use of the engine's main fuel injection system or through a supplementary fuel injection system.

Preferably, supplementary fuel contemplated for filter rejuvenation, is achieved through the use of the main fuel system including pump 27 and injectors 11. Thus, during periods when it is desired to raise the exhaust gas temperature, a predetermined, controlled amount of supplementary fuel is metered to a non-working or immobilized cylinder.

This latter fuel can be a supplementary gas, such as propane, or merely the primary diesel fuel being used for engine operation. Supplementary fuel charge can be injected into the non-operating or immobilized cylinders in no particular manner or timing sequence, since it will be swept or aspirated through the open exhaust valve, into the exhaust gas stream under all conditions.

Injected supplementary fuel is forced from the immobilized cylinder combustion chamber 16 by action of pistion 13, and through intermixing with the heated exhaust gas stream. Thereafter, the fuel/gas mixture is directed through conduit 23 to contact the catalytic segment 37 of fuel filter 24.

In segment 37, combustion of the fuel/gas mixture is enhanced through contact with the catalyst layer so that the exhaust gas stream is raised from its lower than desired temperature. The heated gas, as it contacts bed 36 will initiate and sustain combustion of the bed retained carbon particles.

Supplementary fuel injection is continued only for a sufficient time to raise the exhaust gas to its desired temperature. Thereafter, supplementary fuel introduction is discontinued and the burning of retained carbon is sustained or reduced until the carbon is completely incinerated from filter bed 36.

To acheive immobilization of one or more cylinders 12, engine power regulator means 41 functions automatically, and is communicated with valve override mechanism 42 and 43 by connecting lines 44 and 45. Thus, during light engine load periods, valve override mechanisms 42 and 43 will be activated to fix intake valve 17 in closed position, and exhaust valve 18 in open position. Concurrently controller 41 will course the flow of fuel to immobilized cylinder 12 to be interupted by closing valve 48 in fuel line 26.

When it becomes necessary to rejuvenate filter bed 36, by incinerating accumulated carbon, the fileer's loaded condition will be indicated by the build-up of a backpressure in the exhaust gas system. Filter 24 is thus provided with one or more pressure sensing elements 46. The latter function in the normal way to establish a signal which is transmitted to the fuel circuit within power controller 41.

When an excessive degree of backpressure is sensed at element 46, the latter will cause a signal to be impressed on power regulator means 41 so that an amount of secondary fuel will be delivered to a non-operating cylinder 12. While this secondary fuel injection as noted herein can be achieved through a separate fuel system, it can also be achieved, as in the instant arrangement through the primary fuel system.

The secondary fuel therefore when utilizing diesel fuel, originates at pump 27 and injector 11. The timing of the secondary fuel injection can be coordinated with or completely independent of the primary fuel injection timing. In any event, it is regulated by controller 41 which in turn controls the disposition of valve 48.

Since the carbon accumulation will take place only when the engine runs at lower loads and consequently produces a low temperature exhaust gas stream, it will be necessary to rejuvenate the filter only under such conditions. It is appreciated that at higher loads when the exhaust gas temperature achieves the point where it will ignite the accumulated carbon, no secondary fuel injection is required.

When filter rejuvenation does take place due to secondary fuel injection, the injected fuel will intermix with oxygen containing exhaust gas, to form a combustible fuel/gas mixture. As the latter is forced through exhaust manifold 22 and exhaust conduit 24, it will eventually enter the catalytic section 37 of filter 24.

The particle incinerating action within chamber 36 will continue at a relatively orderly rate, determined and regulated by the volume of secondary fuel which is injected. This control of the rejuvenation process is necessary to avoid damaging of the filter media, a circumstance that would come about by an excessively fast burning rate within bed 36.

A temperature sensor 47 is disposed within filter bed 36 and communicated with the engine power control means 41. Thus, should the temperature within bed 36 exceed a predetermined level, temperature sensor 47 will transmit a signal to regulator 41 to discontinue, or again suspend the injection of secondary fuel into the immobilized cylinder.

The engine will thereafter run in its normal manner, depending on the load imposed on the engine.

Although modifications and variations of the invention may be made without departing from the spirit and scope thereof, only such limitations should be imposed as are indicated in the appended claims.

We claim:

1. Method for rejuvenating an exhaust gas filter 24 which is communicated with an internal combustion engine 10 having a plurality of cylinders 16, a main fuel injector communicated with each cylinder and being in communication with a fuel pump, said engine 10 including power control means 41 being operable to selectively immobilize at least one of said plurality of cylinders to reduce the engine's power output, said power control means 41 including a fuel flow control element which is operable to discontinue fuel flow to said at least one cylinder during a period when said cylinder is immobilized, said exhaust filter 24 having a bed 36 adapted to retain combustible particulate matter from the exhaust gas stream passing therethrough, and a catalytic element 37 disposed upstream of said bed 36 to enhance preheating of the exhaust gas stream to a sufficiently high temperature to ignite retained particulate matter, which method includes;

introducing a supplementary fuel charge to at least one of said plurality of cylinders after the latter has been immobilized by said power control means 41, whereby the added supplementary fuel is intermixed with exhaust gas to form a fuel/gas mixture which is carried to said filter catalyst chamber 37.

2. In the method as defined in claim 1 wherein the introduction of a supplementary fuel charge to the said at least one immobilized cylinder is regulated in response to backpressure within the filter bed resulting from accumulation of combustible particles.

3. In the method as defined in claim 2 wherein the introduction of a supplementary fuel charge to said at least one immobilized cylinder is maintained until retained particulate matter within said filter bed is completely incinerated.

4. In the method as defined in claim 1 wherein the introduction of a supplementary fuel charge to the said at least one immobilized cylinder is discontinued in response to a rise within said filter bed, beyond a predetermined temperature.

5. In the method as defined in claim 1 wherein said supplementary fuel charge comprises diesel fuel.

6. In the method as defined in claim 1 wherein said supplementary fuel charge comprises a combustible gas.

7. In the method as defined in claim 6 wherein said gas is propane.

8. In the method as defined in claim 1 wherein said supplementary fuel charge is introduced to the said immobilized cylinder through said cylinder's main fuel injector.

* * * * *